US005601134A

United States Patent [19]

Pinkalla et al.

[11] Patent Number: 5,601,134

[45] Date of Patent: Feb. 11, 1997

[54] RETAINER ASSEMBLY FOR ROLL-UP DOOR

[75] Inventors: Cary Pinkalla, Fox Point, Wis.; Garrett L. Goins, Dubuque, Iowa

[73] Assignee: Rite-Hite Corporation, Milwaukee, Wis.

[21] Appl. No.: 409,312

[22] Filed: Mar. 23, 1995

[51] Int. Cl.[6] ..... E06B 5/00; E06B 5/02

[52] U.S. Cl. ..... 160/271; 160/272; 160/275

[58] Field of Search ..... 160/271, 272, 160/275, 264, 290.1, DIG. 8

[56] References Cited

U.S. PATENT DOCUMENTS

| | | | |
|---|---|---|---|
| 970,135 | 3/1910 | Taylor | 160/264 |
| 1,143,863 | 9/1914 | Schenk | 160/264 |
| 1,476,336 | 8/1922 | Hitchings | 160/290.1 |
| 1,550,237 | 8/1925 | Beckman . | |
| 1,553,425 | 7/1923 | Zumwalt | 160/275 |
| 1,683,884 | 2/1926 | Neveu | 160/275 |
| 2,406,272 | 8/1946 | Van Voorhees . | |
| 2,845,117 | 4/1958 | Barry . | |
| 3,017,927 | 10/1959 | Demko | 160/271 |
| 3,146,824 | 9/1964 | Veilleux | 160/290.1 |
| 3,149,665 | 9/1964 | Handford . | |
| 3,750,740 | 8/1973 | Newman | 160/264 |
| 4,452,292 | 3/1984 | Leivenzon et al. . | |
| 4,569,383 | 2/1986 | Wentzel . | |
| 4,800,946 | 1/1989 | Rosenoy . | |
| 4,825,921 | 5/1989 | Rigter | 160/271 |
| 4,934,437 | 3/1990 | Kraeutler . | |
| 5,078,197 | 1/1992 | Weishar . | |
| 5,117,892 | 6/1992 | Murray | 160/272 |
| 5,123,474 | 3/1992 | Smith . | |
| 5,353,859 | 10/1994 | Oltahfer et al. . | |

FOREIGN PATENT DOCUMENTS 125217 11/1984 European Pat. Off. .

2556403 6/1985 European Pat. Off. .

OTHER PUBLICATIONS

"Re–Coil Away Specifications"; M & I Door Systems Limited; Date unknown; 2 pages.

"'Re–Coil Away' Door System Installation Instructions"; M & I Door Systems, Ltd.; May 1991; 18 pages.

"M & I Door Systems Limited" Product Brochure; M & I Door Systems Limited; Date unknown; 4 pages.

"Rytec Breaks Away" Products Brochures; Rytec Corporation; 1992; 2 pages.

"Rapid Roll Doors: The Super–Fast Solution!" Products Brochure; Albany International; 1990; 8 pages.

"Marathon Spirit" Products Brochure; Marathon Door Division—ASI Technologies; 1991; 3 pages.

"RT Series" Product Brochure; Kelley Company, Inc. 1993; 2 pages.

"Kelley Door Selection Guide"; Kelley Company, Inc.; 1993; 16 pages.

"Speedor" Product Brochure; Hart; Date unknown; 2 pages.

*Primary Examiner*—Brian K. Green
*Assistant Examiner*—Curtis A. Cohen

[57] ABSTRACT

A vertical retainer assembly for a roll-up door that selectively blocks and unblocks a doorway, the door including a curtain attached to a roller, and vertical members disposed on either side of the doorway, which include vertically-disposed guide tracks for receiving and guiding the curtain in a vertical plane, the vertical retainer assembly compromising: a horizontally disposed member attached to the curtain, the member being movable out of the vertical plane of the door; and a retaining surface in one of the vertical members at a location external to the guide track, the horizontally disposed member being selectively engageable with this retaining surface which vertically retains the member against upward movement, and prevents the roller from being actuated to roll up the curtain.

8 Claims, 5 Drawing Sheets

RETAINER ASSEMBLY FOR ROLL-UP DOOR

FIELD OF THE INVENTION

The present invention is related generally to industrial doors, and more particularly to a vertical retaining assembly for a roll-up door.

BACKGROUND OF THE INVENTION

Roll-up doors may be used in a variety of environments. Such roll-up doors typically include a curtain which may be wound or unwound from a horizontally disposed roller, typically in place above the doorway which is to be blocked and unblocked by the curtain. The door is closed by rotating the roller such that the curtain pays off of the roller to block the doorway. The door is then opened by rolling the roller in an opposite direction. One example of a roll-up door is a door that is actuated like a window shade — with manual actuation down and a spring-loaded roller for causing the door to roll-up when properly released. Such manual roll-down, spring-loaded roll-up doors are typically used in a light-duty environment. For example, such a door may be used in combination with a heavy-duty door in the exterior doorway of a loading dock in a manufacturing or warehouse facility. In such an installation, the heavy-duty door is typically used to prevent or allow authorized access to the doorway. Typical doors used for this purpose are manual or powered roll-up doors or so-called overhead doors (e.g. a garage-type sectioned door moveable from a vertical blocking position, to an overhead, horizontal storing position). In such an environment, the purpose of the manual roll-down, spring-loaded roll-up door may be to protect the opened doorway and the warehouse beyond from airborne pests such as insects when the heavy duty door is in the open position, but passage through the doorway is not required. To achieve this desirable function, these doors typically include a curtain in the form of a mesh material, with the mesh being small enough to block most insects, but large enough to allow significant air flow through the door. To further aide in preventing the ingress of insects into the warehouse, such doors typically include guide tracks disposed within vertical members for receiving the side edges of the door, and guiding those side edges in a vertical plane. In addition to performing the guiding function, the guide members may also provide some amount of sealing of the side edges of the curtain to prevent passage of insects.

Similarly, the leading edge of such a door typically also includes a seal to seal between the leading edge of the door and the dock surface below. Of course, one knowledgeable of such installations will appreciate that this lower surface may be the dock floor, or a dock leveler disposed on or in that dock floor. The bottom seal may be some type of deformable material to insure a tight seal between the bottom of the door and the dock floor or leveler. In order for the seal to perform most effectively, the door in its closed position must be accurately vertically positioned. Further, the door should not be subject to any vertical creep by virtue of the spring-loaded roller imparting incidental upward movement to the door.

SUMMARY OF THE INVENTION

It is thus a primary object of the invention to provide for accurate vertical positioning of roll-up door in the door-blocking position.

It is a related object to provide for such vertical positioning, while still allowing sufficient movement of the bottom edge of the door in the event of accidental actuation of a dock leveler beneath the door while it is in the closed position.

Other objects and advantages of the invention will become apparent from the description to follow.

In accordance to these and other objects, there is provided a vertical retainer assembly for a roll-up door, illustratively of the manual roll-down, spring-loaded roll-up variety, that selectively blocks and unblocks a doorway. The door itself typically includes a curtain attached to a roller, and vertical members disposed on either side of the doorway. The vertical members include vertically-disposed guide tracks for receiving and guiding the curtain in a vertical plane. The vertical retainer assembly according to the invention compromises a horizontally disposed member attached to the curtain, the member being movable out of the vertical plane of the door. The vertical retainer assembly also includes a retaining surface which, in the preferred embodiment, is in one of the vertical members at a location external to the guide track. The horizontally disposed member is selectively engageable with this retaining surface which vertically retains the member against upward movement, and prevents the roller from being actuated to roll up the curtain. When it is desired to roll-up the curtain, the post may be disengaged from the retaining surface, and the door normally actuated to roll-up the curtain.

According to a preferred embodiment of the invention, the horizontally disposed member is a post which extends across the width of the curtain, and is attached to the curtain by means of a fabric flap attached along the width of the curtain, and along the length of the post. The guide tracks guide the ends of the horizontal post in a vertical plane during vertical movement of the door. To provide for the vertical retention of the horizontal post, each guide track and its associated vertical member include aligned horizontal slots, and retaining members, each including retaining surfaces, are disposed adjacent to and above the aligned slots. The horizontal post is moveable through the slot between a position wherein it is disposed within the guide track (during normal up and down movement of the curtain) and a position wherein it is disposed external to the guide track for engagement with the retaining surfaces of the retaining members.

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Figure 1:
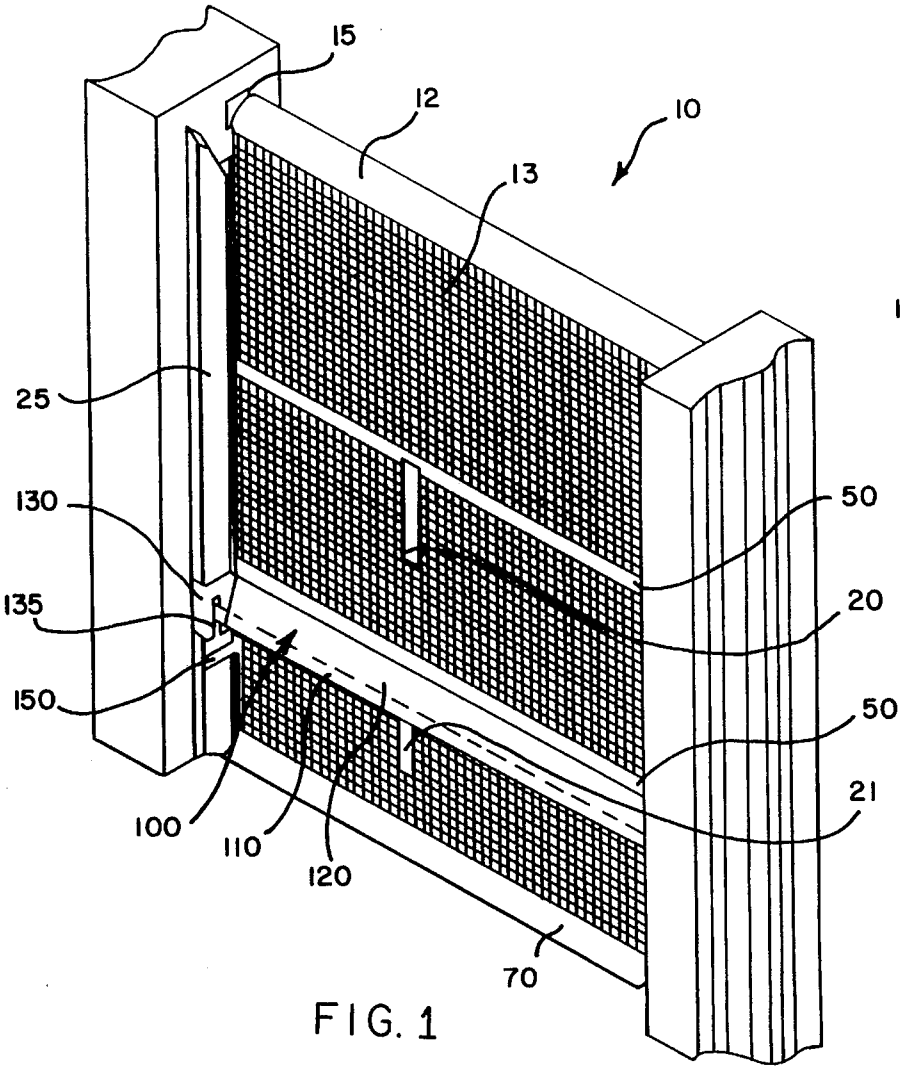
FIG. 1 is an elevational view of a first embodiment of the vertical retainer assembly according to the invention.

Turning now to FIG. 1, there is shown a roll-up door including a vertical retainer assembly according to the invention. The door is designated generally by reference numeral 10 and includes a roller 12 onto which a curtain 13 may be wound and unwound. The door 10 according to the present embodiment is of the manual roll-down, spring-loaded roll-up variety although the invention is usable with other manual or powered roll-up doors. Roller 12 includes appropriate internal mechanisms and side brackets (such as 15) to provide for spring-loaded roll-up. The curtain is a fine wire mesh such as will prevent passage of insects and other airborne pests, but which allows significant airflow. To assist the user in rolling and unrolling door 10, straps 20, 21 may be attached along the length of the door. A further strap (not shown) is also attached at the leading edge of the door to allow it to be actuated from the rolled-up position.

Door 10 also includes vertical members 25 disposed on either side of the door (the view of FIG. 1 does not show the side member on the right side of the door). Mounted within each of the vertical members 25 is a vertically disposed guide track 30. Both the guide tracks 30 and vertical members 25 can be seen more clearly in the exploded view of FIG. 3. The guide tracks are preferably formed of PVC (polyvinyl chloride), and receive the curtain for guiding the curtain in a vertical plane. As will be discussed below, various components may be mounted to the curtain, either across its width, or vertically along its side edges. Accordingly, when it is stated herein that the guide tracks receive and guide the curtain in a vertical plane, such language is intended to cover not only receipt and guiding of the actual curtain, but also any such components as may be mounted to the curtain.

To give the door stability in a vertical plane against wind or other pressure differentials, optional wind bars 40 may be included along the width of the door. In the present embodiment, the door includes pockets 50 for receiving the wind bars 40. The wind bars are also received within the vertically-disposed guide tracks 30, and are guided thereby. Forming vertical guide tracks 30 of PVC insures that any friction between the wind bars (which are thicker than the door) and the guide tracks (or between the guide tracks and other components mounted to the curtain, or the curtain itself) do not adversely affect the operation of the door. Similarly, a bottom bar 60 may also be employed at the leading edge of the curtain. A sweep 70 may also be used between the door and the floor surface. A bottom seal (not shown) may also advantageously be used. Such a bottom seal is illustratively made of a deformable material which engages the floor or dock leveler surface beneath the door for the purpose of positively sealing the bottom of the door against insects and other pests. In the closed position, the door must be in the proper vertical position for the bottom seal to function properly, thus leading, in part, to the need for the vertical retainer assembly according to the invention.

Returning to FIG. 1, the vertical retainer assembly 100 is shown. In the present embodiment, the vertical retainer assembly includes a horizontally-disposed member in the form of a horizontal post 110 which extends the width of the curtain 13, although a member extending less than the width of the curtain may also be used (see FIG. 5). In this embodiment, post 110 is attached to the curtain 13 along its length in such a way that post 110 can move out of the vertical plane of the door 13. In the present embodiment, the attachment between the post 110 and curtain 13 is in the form of a fabric flap 120. Illustratively, flap 120 may be sewn along its length to the width of curtain 13 in proximity to one of the pockets 50 for wind bars 40. Further, flap 120 may be only intermittently attached to the curtain 13 and/or may be sewn at any other height along the door. A pocket or loop in the other end of flap 120 may be employed to retain the horizontal post 110. The width of flap 120 (the distance between its attachment to the door and post 110) is exaggerated for clarity. Presently, the preferred width for the flap is ¾ inch (see FIG. 4).

For the purpose of vertically retaining the curtain 13 against upward movement in this preferred embodiment, horizontal post 110 is engageable with at least one retaining member 130 mounted to one of the vertical members 25 external to the guide track 30. Preferably a retaining member 130 is mounted to each vertical member 25. As can be seen in FIG. 1, retaining member 130 includes a vertical slot 135 for receiving horizontal post 110. Vertical slot 135 includes an upper, horizontally-extending retaining surface, seen more clearly in FIG. 3, and designated by reference numeral 136. Engagement of post 110 with this retaining surface retains post 110 against upward vertical movement. Although the retaining surface in the present embodiment is horizontal, the invention is not so limited. Rather, the invention includes other retaining surfaces including angled surfaces, curved surfaces and notched surfaces. Further, while the retaining surface in the present embodiment is disposed within a retaining member attached to the vertical member, the retaining surface may also form a part of the vertical member, as discussed in greater detail in regard to FIG. 5. Further still, while the retaining members described herein are passive in that they do not include moving parts, other retaining members, such as spring-loaded latches or the like, also fall within the scope of the invention.

Figure 3:
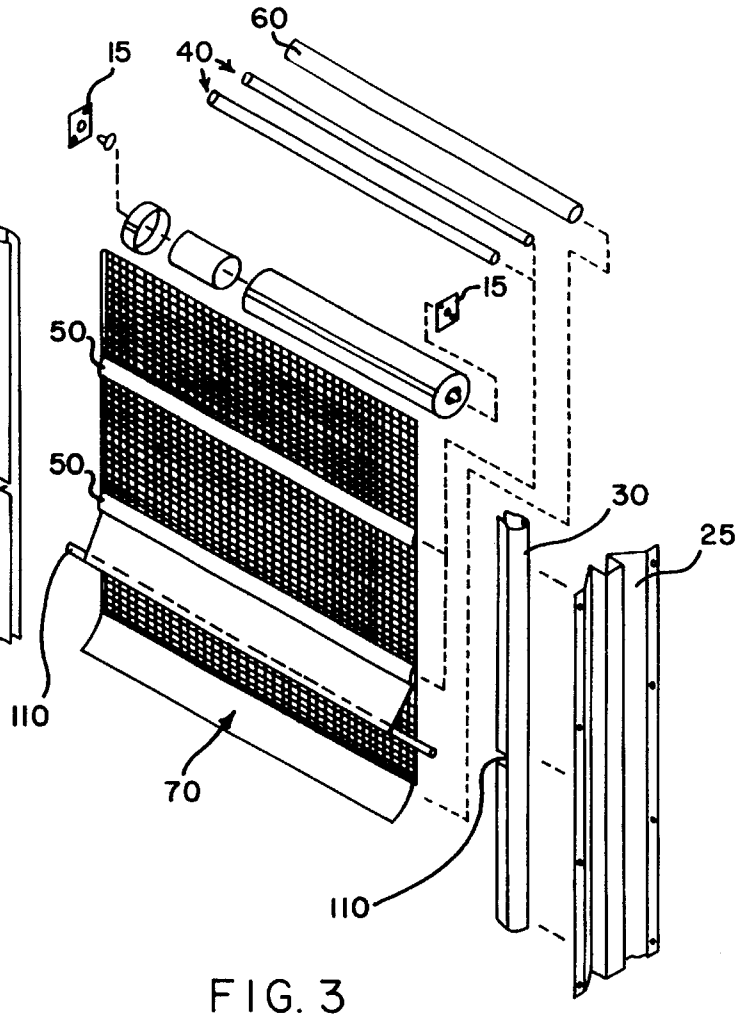
FIG. 3 is an exploded view of a door of FIG. 1.

Further, while a simplified retaining member is shown in FIGS. 1 and 3, the presently preferred retaining member **130*a* is shown in perspective in FIG. 4** to be discussed in greater detail below.

To prevent the retainer assembly from unduly interfering with normal operation of the door, the retaining members of the present embodiment are mounted to the vertical members external to the guide track 30. According to this preferred embodiment, the ends of the horizontal posts 110 beyond flap 120 are typically disposed within guide tracks 30 in the vertical members 25 during operation of the door. However, when it is desired to vertically retain the door in the given position, the ends of horizontal bar 110 are removed from the guide track for engagement with retaining members 130. A horizontal slot 150 is formed in the vertical members 25 for this purpose and aligned slot 160 is formed in the guide tracks 30 (see FIG. 3). Preferably, a handle is disposed along post 110 to simplify movement of the post out of the plane of the door through the slots 150. It is also within the scope of the invention for the ends of post 110 to always remain outside of the guide tracks 30 during all movement of the door. To allow curtain 13 to roll up in that arrangement, however, post 110 and retaining members 130 would need to be mounted at or near the leading edge of the curtain, and adjacent the floor, respectively. In such an arrangement, the ends of post 110 would ride along the outside of the vertical members until they were manually engaged with the retaining members.

Figure 2:
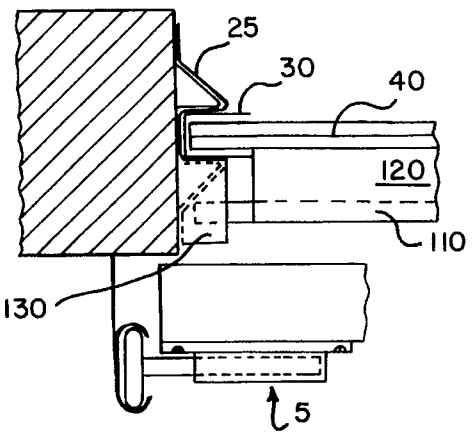
FIG. 2 is a sectional view of the door of FIG. 1.

FIG. 2 shows a top section view of the door of FIG. 1. The relationship between curtain 13, horizontal post 110, and retaining member 130 may be seen in greater detail. It should be noted that the top view of FIG. 2 shows an overhead type door 5, which would be used to restrict access to the doorway over which door 10 is intended for use as an insect shield. FIG. 2 shows one of the wind bars 40 as retained within a pocket 50 on the door. The flap of material 120 is shown connected to the door at the location of wind bar 40. Horizontal post 110 is received within a loop or pocket at the end of flap 120. An end portion of post 110 extends beyond the flap 120, and engages the retaining member 130 to retain post 110 and attached curtain 13 against upward vertical movement. FIG. 2 also shows vertically disposed guide track 30 received within vertical member 25. As can be seen from FIG. 3, retaining member 130 is illustratively in the form of an angle member with a vertical slot 135 and a horizontal retaining surface 136. Again, the presently preferred retaining member **130*a* is shown in FIG. 4. Either retaining member 130 or 130*a* may be secured in a variety of ways to the vertical member 25 external to the guide track 30. According to the preferred embodiment, retainer member 130 is welded to the vertical member 25**.

Returning briefly to FIG. 1, the operation of door 10, according to the present embodiment, will be described. Straps 20 and 21 may be grasped by an operator for the purpose of manually lowering the door. Further, the door may be raised by briefly pulling straps 20 and then releasing them such that spring-loaded roller 12 will roll the curtain 13 onto the roller. During normal up and down operation of the door, horizontal post 110 will be received within and guided by vertically disposed guide tracks 30 received within the vertical members 25, which tracks also receive and guide the curtain. When it is desired to maintain the door in a given vertical position, such as the closed position, the retaining assembly according to the invention is used. The door is manually actuated to a position wherein the horizontal post 110 is aligned with slots 150. Horizontal post 110 is then moved (preferably by means of a handled mounted along post 110) out of the plane of the door such that its ends come out of guide track 30. The swinging attachment between post 110 and curtain 13, as provided in this embodiment by flap 120, provides for such movement. With the horizontal post now outside of guide track 30, the ends of the post 110 may be engaged with retaining surfaces in the retaining members 130. Proper actuation of the door to roll the curtain onto the roller 12 while posts 110 are engaged with retaining members 130 will cause post 110 to abut the retaining surface of the vertical slot 135 in retaining member 130, thus maintaining curtain 13 in a vertical position. At the same time, horizontal post 110 and curtain 13 are retained against upward vertical movement.

The door shown in FIGS. 1–3 is representative of doors including a vertical retainer assembly according to the invention, and modifications of the door of FIG. 1 may be made. However, such modifications would still fall within the scope of the invention. For example, horizontal post 110 has been shown to have a swinging engagement with curtain 13 by means of flap 120. Such a flap is not necessary, and the attachment may also be provided, for example, by a series of chains or posts spacedly connected between horizontal post 110 and the curtain 13 at various points along the width of the curtain. Regardless of the type of attachment between horizontal post 110 and curtain 13, it is important for the purpose of this embodiment of the invention that horizontal post 110 be allowed to move out of the vertical plane of the door so that the post 110 can be removed from guide tracks 30 for the purpose of engaging with retaining members 130. Toward this end, a separate horizontal member such as bar 110 need not be used at all. That is, a wind bar, such as 40 could serve the same purpose. In such an embodiment of the invention, the width of the curtain is such that the curtain edges are not retained in the guide tracks, but portions of the wind bar extending beyond the curtain edge would be so received. To vertically retain the curtain, the wind bar would be pulled out of the guide track to engage a retaining surface. Both this embodiment and the one shown in FIGS. 1–3 (and others) fall within the scope of this aspect of the invention as they both include a horizontally disposed member (post 110 or wind bar 40), which is movable out of the vertical plane of the door, and which is engageable with a retaining surface to vertically retain the member and the curtain to which it is attached.

Further, the vertical position of the horizontal bar 110 and retaining members 130 in FIG. 1 are representative. Slot 150, retaining member 130, and horizontal post 110 may be disposed any where along the vertical length of the door. In the present embodiment, only one post 110, slot 150 and member 130, mounted at a distance about three feet above the bottom of the curtain are used although a plurality of these elements could also be used. The vertical position of post 110, slot 150 and member 130, as shown, is preferred particularly in situations where door 10 is to be used in combination with a loading dock including a dock leveler installed in the floor of the dock. With the retaining member 130 and horizontal post 110 being disposed at this height, the remainder of the curtain beneath post 110 is free hanging. This is advantageous in the event of accidental actuation of the dock leveler while the door is closed. If the retaining member 130 and horizontal post where at the bottom of the door, such accidental actuation of the dock leveler could lead to damage of the curtain. This would not be the case, however, if the bottom portion of the door were free hanging as it is in the embodiment shown in FIG. 1. The vertical location of retaining member 130 relative to slot 150 may also be different than shown in FIG. 1.

Figure 9:
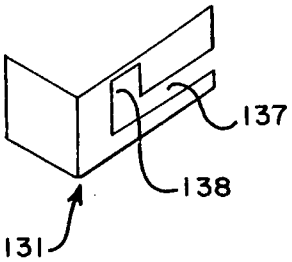
FIG. 9 is an alternative retaining member according to the invention.

Retaining member 130 has been shown with only a vertical slot 135, including a retaining surface 136. However, compound slots could also be used. For example, a compound slot having both a horizontal projection and a vertical projection could be used. Such a retaining member 131 is shown in FIG. 9. The slot includes a horizontal projection 137, and a vertical projection 138. Such a construction may be advantageous in that the upper surface of horizontal projection 137, as well as the upper surface of vertical projection 138 both serve as retaining surfaces which may engage horizontal post 110, and retain it against upward vertical movement. Use of a retaining member 131 like that shown in FIG. 9 would require that the horizontal projection 137 be aligned with the slot 150 in the vertical member 25.

Figure 4:
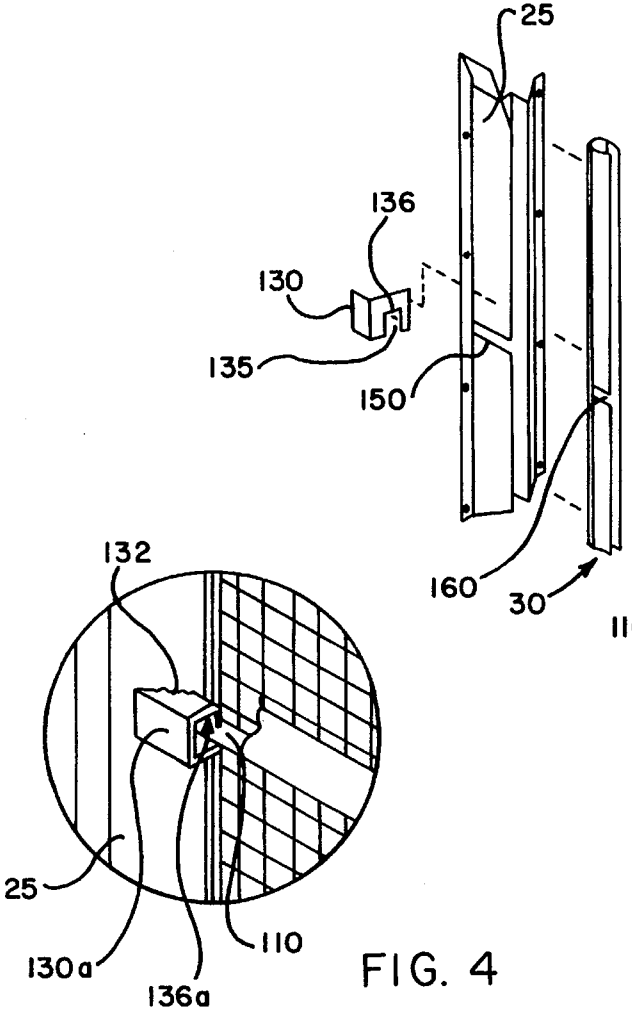
FIG. 4 is a perspective view of a preferred retaining member.

The presently preferred retaining member **130*a* is shown in the perspective view of FIG. 4. Retaining member 130*a* is a piece of a square tube stock which may be cut so that one surface flushly engages the vertical member 25 as along line 132. The retaining member 130*a* is disposed along vertical member 25 such that its internal cavity is in registration with the horizontal slot in vertical member 25 (hidden from view in FIG. 4). This allows horizontal post 110 to be pulled out of the plane of the door through slot 150 and into engagement with retaining member 130*a*. Retaining member 130*a* includes an upper horizontal surface 136*a*** which serves as the retaining surface.

Figure 6:
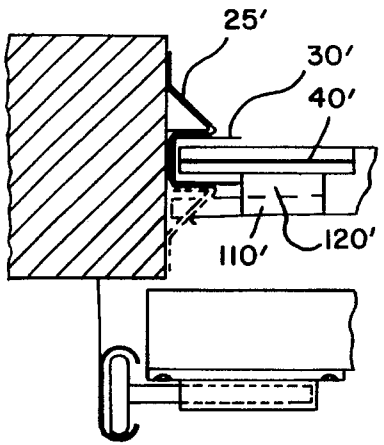
FIG. 6 is a sectional view of the door of FIG. 5.
Figure 5:
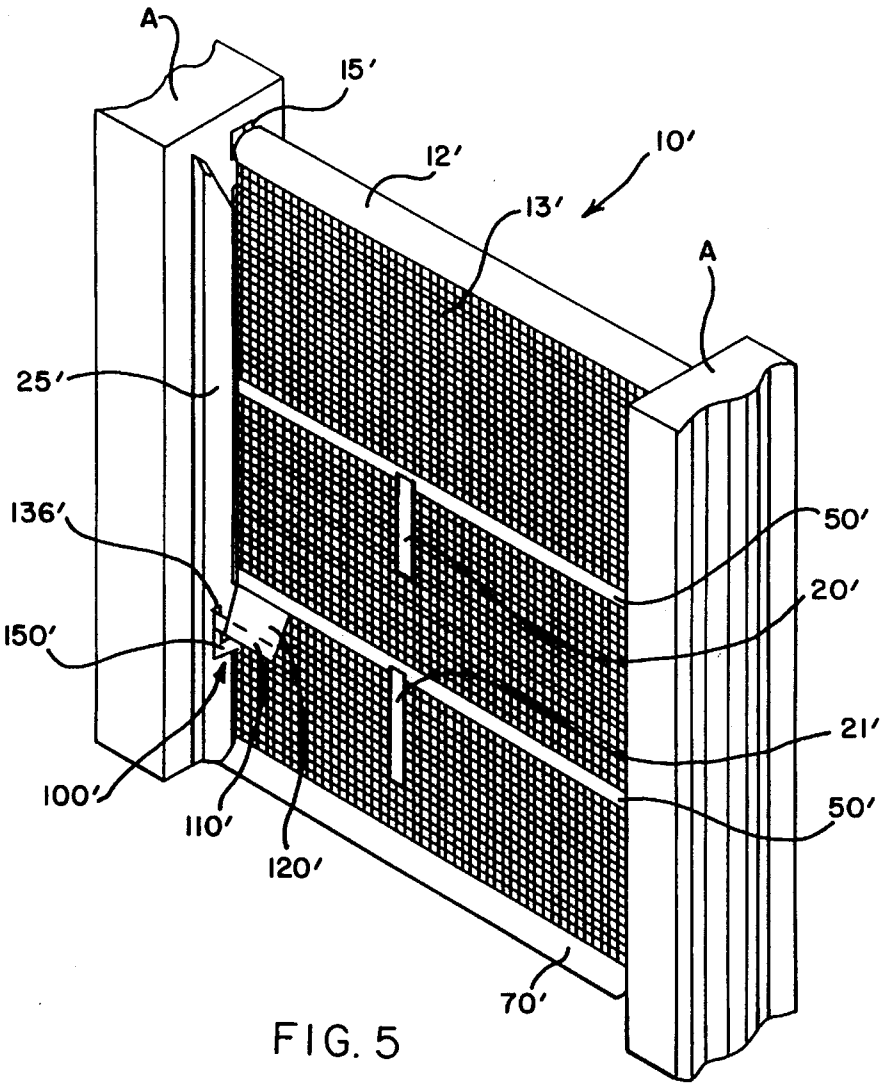
FIG. 5 is an elevational view of an alternative embodiment of a vertical retainer assembly according to the invention.

An alternative embodiment of the vertical retainer assembly according to the invention is shown in FIGS. 5 and 6. Since this embodiment is very similar to the embodiment shown in FIGS. 1 and 2, like elements will be designated by like numerals, followed by a prime (′). Although only one post 110′ is shown in FIG. 5, a post 110′ will preferably be disposed at a similar height on both edges of the door. Post 110′ is attached to curtain 13′ by means of a flap 120′ allowing post 110′ to move out of the vertical plane of the curtain. In the embodiment of FIG. 5, the retaining surface for vertically retaining the post 110′ and the attached curtain 13′ is not formed in a separate retaining member like 130 of FIG. 1. Rather, retaining surface 136′ is formed in or on vertical member 25′ external to guide track 30′ (see FIG. 6). As can be seen, vertical member 25′ extends away from the wall A to which it is mounted, thereby forming a cavity. When post 110′ is retained by engaging surface 136′, its end resides within this cavity. The guide member 30′ includes a slot aligned with slot 150′ (including retaining surface 136′) in member 25′ (FIG. 5). Accordingly, post 110′ is movable from a position within guide track 30′ to a retained position wherein it is disposed outside guide track 30′.

Figure 7:
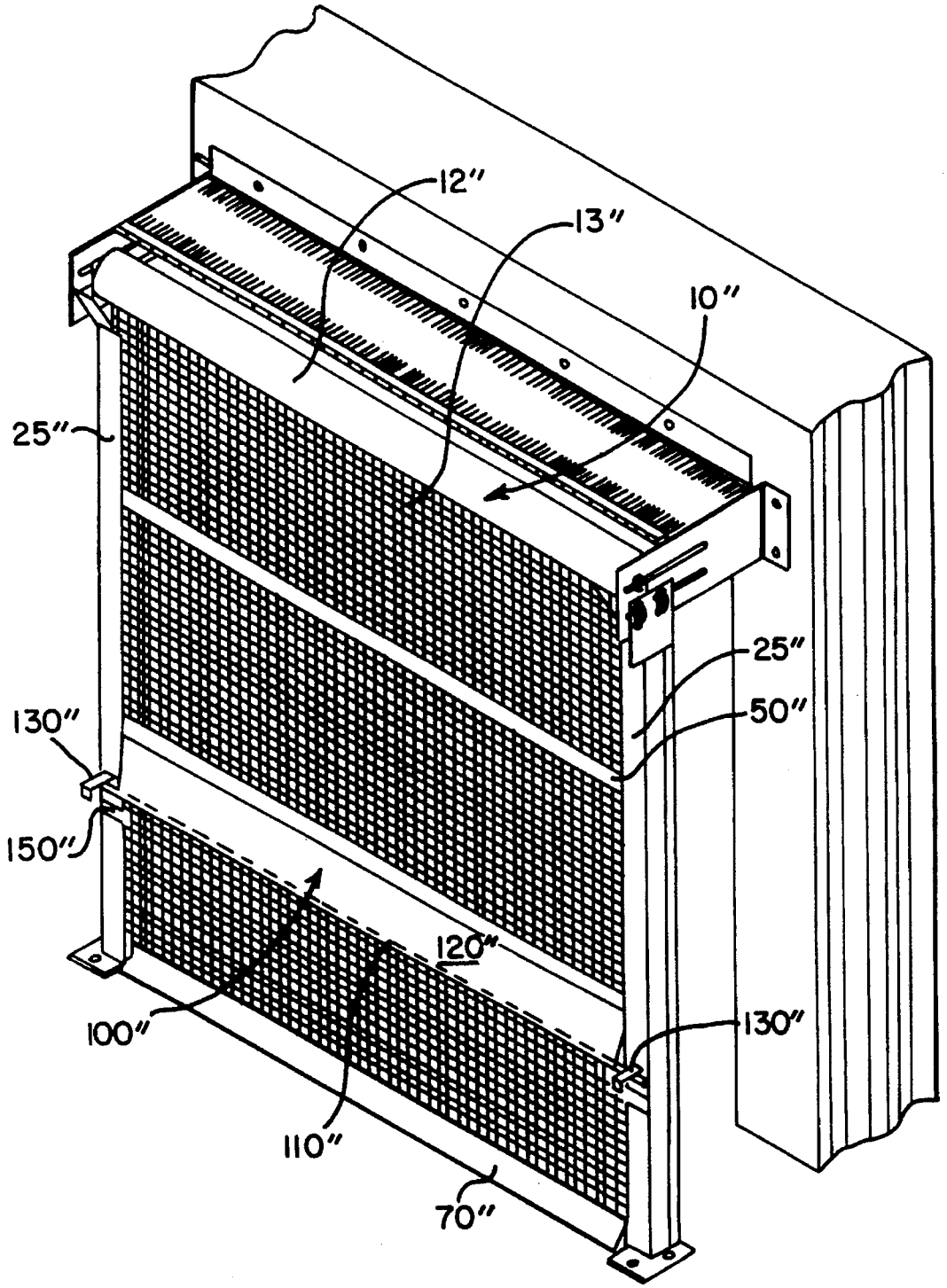
FIG. 7 is an elevational view of a further alternative embodiment of a vertical retainer assembly according to the invention.
Figure 8:
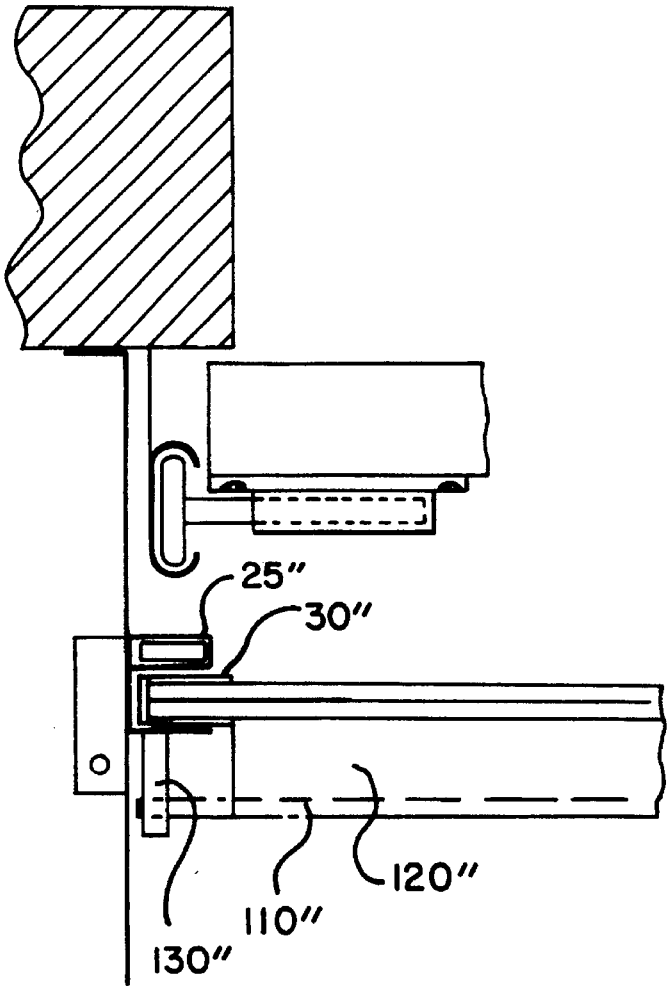
FIG. 8 is a sectional view of the door of FIG. 7.

A further alternative embodiment of the vertical retainer assembly according to the invention is shown in FIGS. 7 and 8. Since this embodiment is also very similar to the embodiment shown in FIGS. 1 and 2, like elements will be designated like numerals, followed by a double prime (″). Door 10″ includes a roller 12″ and a curtain 13″. Vertical members 25″ are disposed on either side of the door. Although not shown in FIG. 7, vertical members 25″ also include guide tracks as seen most clearly in FIG. 3. Optional wind bars may be provided within pockets 50″ in the door of FIG. 7. The door also includes a vertical retainer assembly 100″. The retainer assembly includes a horizontal member in the form of a post 110″ which is attached to the curtain 13″ by means of a fabric flap 120″. This attachment between horizontal post 110″ and curtain 13″ allows post 110″ to move out of the vertical plane of the door. Retaining members 130″ are disposed on each vertical member external to the guide members housed within the vertical members 25″. In this embodiment, retaining members 130″ are in the form of simple u-shaped brackets, including downwardly-depending legs and a horizontally disposed bail section. The horizontal bail section serves as the retaining surface for engaging horizontal post 110″ to retain post 110″ and attached curtain 13″ against upward vertical movement. As in previous embodiments, vertical members 25″, and enclosed guide members 30″ include aligned slots 150″ to allow horizontal post 110″ to be moved from a position wherein it is within guide members 30″ to a position wherein it is outside of the guide members 30″. The top view of FIG. 8 shows the structure of the retaining member and the horizontal post 110 in further detail. The operation of door 10″ as compared to door 10 in FIG. 1 is nearly identical, and similar modifications may be made to door 10″ as were discussed in regard to the door of FIG. 1.

Figure 10:
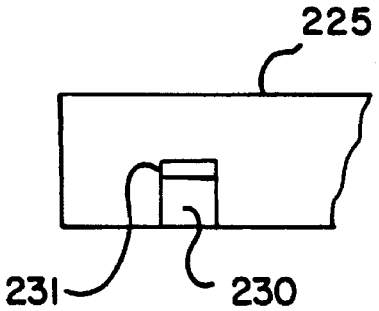
FIG. 10 is a further alternative retaining member according to the invention.

In a further alternative embodiment, the retaining member may be disposed within the guide tracks as opposed to being external to the guide tracks as was the case in the previous embodiments. A top sectional view of such a guide track 225 is shown in FIG. 10. A retaining member 230 is also shown. As with previous retaining members, retaining member 230 would include an illustratively horizontally disposed retaining surface. According to this embodiment, retaining member 230 would also include a downwardly-depending portion shown in the top view of FIG. 10 at 231. While the presence of retaining member 230 in guide track 225 serves as something of an obstacle to normal up and down operation of the door, it also performs the desired vertical retaining function according to the invention. As in previous embodiments, a horizontally disposed member attached to the curtain is selectively engageable with a retaining surface of the retaining member 230 to vertically retain the horizontal member and the curtain to which it is attached. As was the case in the previous embodiments, the horizontally disposed member may either be a separate horizontal post attached along the width of the curtain, or may be one of the wind bars already present in the door. In the previously-described embodiments, the retaining surface was external to the guide track, and thus the horizontally disposed member was moveable out of the vertical plane of the door for the purpose of engaging the retaining surface. In the present embodiment, however, the necessity of the horizontally disposed member being moveable out of the plane of the door is significantly less since only minimal movement of the horizontally disposed member to engage the retaining member within the guide tracks is necessary.

There has thus been shown a simple vertical retainer assembly for retaining a roll-up door in a given vertical position. The retainer assembly may be implemented in either manually actuated roll-up doors, or powered doors. A horizontal member preferably movable out of the vertical plane of the curtain is attached to the curtain and normally rides within the vertical guide track and the vertical members on either side of the doorway. A slot is provided in the vertical members in the guide track to allow the ends of the horizontal member to be moved to a position external to the guide track. A retaining surface is provided on at least one of the vertical members exterior to the guide track. The horizontal member engages the retaining surface for the purpose of vertically retaining the horizontal member and attached curtain against upward vertical movement. One skilled in the art will appreciate that various modifications besides those discussed in this application may be made to the apparatus described, yet still fall within the scope of the invention as defined by the appended claims.

What is claimed:

1. A vertical retainer assembly for use with a roll-up door that selectively blocks and unblocks a doorway, the door including a curtain attached to a horizontally disposed roller, the vertical retainer assembly comprising, vertical members disposable on either side of the doorway, the vertical members including vertically-disposed guide tracks for receiving and guiding the curtain in a vertical plane, a horizontally disposed member attachable along the width of the curtain, the horizontal member being movable out of a vertical plane of the door; and a retaining surface on at least one of the vertical members, the retaining surface being external to the guide track associated with the at least one vertical member, the vertical member and associated guide track including aligned horizontal slots disposed adjacent the retaining surface the horizontal member being selectively engageable with the retaining surface by being movable through said aligned horizontal slots between a position wherein it is disposed within the guide track, and a position wherein it is disposed externally to the guide track for engagement with the retaining surface to vertically retain the horizontal member and the curtain to which it is attached.

2. The vertical retainer assembly of claim 1, wherein a retaining member is mounted to each vertical member, each retaining member including a vertical slot wherein the retaining surface is an upper surface of the slot.

3. The vertical retainer assembly of claim 2 wherein the guide track guides the horizontal member in a vertical plane during vertical movement of the door.

4. The vertical retainer assembly of claim 2 wherein a flap of material is connected between the curtain and the horizontal member.

5. The vertical retainer assembly of claim 2 wherein the retaining elements include compound slots having a horizontal projection and a vertical projection sized to receive respective ends of the horizontal member.

6. The vertical retainer assembly of claim 1, wherein a retaining member is mounted to each vertical member, each retaining member comprising a u-shaped bracket including two legs extending downward from a horizontal bail section forming the retaining surface, one of the legs of each bracket being fixed to a respective vertical member.

7. The vertical retainer assembly of claim 1, wherein a retaining member is mounted to each vertical member, each retaining member including an upper surface defining the retaining surface.

8. The vertical retainer assembly of claim 1, wherein the horizontal member comprises first and second posts, each of said first and second posts being mountable to the curtain adjacent a side edge of the curtain and wherein each vertical member includes a retaining surface.

* * * * *

UNITED STATES PATENT AND TRADEMARK OFFICE

CERTIFICATE OF CORRECTION

PATENT NO. : 5,601,134

DATED : February 11, 1997

INVENTOR(S) : Pinkalla et al.

It is certified that error appears in the above-indentified patent and that said Letters Patent is hereby corrected as shown below:

ON THE TITLE PAGE:
Under "Other Publications" a publication was unentered on the title page. The publication is as follows:

Albany International Competitor Data Sheet; Oct. 1989; 2 pages.

Signed and Sealed this

Fifth Day of August, 1997

Bruce Lehman

*Attest:*

BRUCE LEHMAN

*Attesting Officer*

*Commissioner of Patents and Trademarks*